US005226927A

United States Patent [19]

Rundstrom

[11] Patent Number: 5,226,927

[45] Date of Patent: Jul. 13, 1993

[54] WOOD GASIFIER

[75] Inventor: David A. Rundstrom, Huntington Beach, Calif.

[73] Assignee: Southern California Edison, Rosemead, Calif.

[21] Appl. No.: 655,764

[22] Filed: Feb. 13, 1991

[51] Int. Cl.[5] ..... C10J 3/26; C10J 3/40; C10J 3/42

[52] U.S. Cl. ..... 48/76; 48/66; 48/68; 48/85.1; 48/85.2; 48/111

[58] Field of Search ..... 48/62, 63, 64, 66, 67, 48/68, 69, 76, 85.1, 85.2, 87, 111; 110/229

[56] References Cited

U.S. PATENT DOCUMENTS

| | | | |
|---|---|---|---|
| 514,994 | 2/1894 | Hutchinson et al. . | |
| 594,540 | 11/1897 | Kitson . | |
| 654,457 | 7/1900 | Jefferies . | |
| 1,033,611 | 7/1912 | Nau . | |
| 1,161,404 | 11/1914 | Nau . | |
| 1,243,822 | 10/1917 | Dreffein . | |
| 1,412,921 | 4/1922 | Chapman . | |
| 1,506,826 | 9/1924 | Galusha . | |
| 1,524,511 | 1/1925 | Dreffein . | |
| 1,599,587 | 2/1926 | Rogers et al. . | |
| 1,676,148 | 7/1928 | Lummis . | |
| 1,798,617 | 3/1931 | McDonald . | |
| 1,821,263 | 9/1931 | Imbert | 48/26 |
| 1,860,841 | 5/1932 | McEver . | |
| 1,888,586 | 11/1932 | Chapman . | |
| 1,917,839 | 7/1933 | Haug | 48/66 |
| 2,017,340 | 10/1936 | Corbett . | |
| 2,143,017 | 1/1939 | Koppers | 48/66 |
| 2,337,053 | 12/1943 | Langley . | |
| 2,440,940 | 5/1948 | Galusha . | |
| 2,656,799 | 10/1953 | Hatton . | |
| 3,824,935 | 7/1974 | Yamato et al. . | |
| 3,841,851 | 10/1974 | Kaiser . | |
| 3,902,436 | 9/1975 | Turner et al. . | |
| 3,970,436 | 7/1976 | Livemore | 48/76 |
| 4,134,738 | 1/1979 | Bress et al. . | |
| 4,213,404 | 7/1980 | Spaulding . | |
| 4,270,464 | 6/1981 | Kerres . | |
| 4,291,634 | 9/1981 | Bergsten et al. . | |
| 4,306,506 | 12/1981 | Rotter | 48/76 |
| 4,336,131 | 6/1982 | Schmidt et al. . | |
| 4,388,082 | 6/1983 | Guttmann et al. | 48/76 |
| 4,441,436 | 4/1984 | Hayashi . | |
| 4,459,136 | 7/1984 | Linneborn et al. | 48/76 |
| 4,498,909 | 2/1985 | Milner . | |
| 4,562,777 | 1/1986 | Van Der Voort . | |
| 4,583,992 | 4/1986 | Rogers | 48/76 |
| 4,655,146 | 4/1987 | Lemelson . | |
| 4,659,340 | 4/1987 | Weaver . | |
| 4,672,899 | 6/1978 | Kainer . | |
| 4,747,355 | 8/1988 | van Berkum . | |
| 4,929,254 | 5/1990 | Kooiman et al. | 48/76 |

*Primary Examiner*—Peter Kratz
*Attorney, Agent, or Firm*—Denton L. Anderson

[57] ABSTRACT

A vertical, countercurrent, updraft reactor is provided which can be advantageously used to produce synthesis gas by the partial oxidation of a solid fuel, especially a wood particle fuel. The reactor has a substantially cylindrical, vertical shell. The reactor has a fuel inlet opening in the upper portion of the reactor and an ash outlet opening in the lower portion of the reactor. Also in the lower portion of the reactor is a synthesis gas outlet opening. A heating zone is created within the reactor by internal heating zone walls which terminate at a lower-most edge. A grate is located below the heating zone. The outer perimeter of the grate and the lower-most edge of the heating zone walls form an annular slit which allows ash to gravitate out of the heating zone and into the lower-most portion of the reactor. The grate is reciprocal so that the annular slit can be periodically narrowed and widened.

16 Claims, 1 Drawing Sheet

WOOD GASIFIER

BACKGROUND

The invention relates generally to the disposal of solid wastes, and in particular to the disposal of wood wastes by gasification.

The disposal of solid waste materials has become a major problem in this country. In the Southern California area, for example, over 60,000 tons of solid waste materials must be disposed in landfills every day. As the amount of solid waste increases and the number of usable landfill sites decreases, the problem of solid waste disposal rapidly approaches crisis proportions.

A major component of solid waste materials is wood waste. For example, of the 60,000 tons per day of solid waste generated in Southern California, over 5,000 tons per day are wood wastes. Wood wastes, being organic and being generally free of metal and other contaminants, offer the possibility of alternative disposal and energy generation through some form of incineration. Incineration devices for wood waste are known in the art. However, such devices have been considered impractical for large-scale, continuous disposal of large varieties of wood wastes because of the considerable expense, operating difficulties and/or air pollution normally associated with the use of such devices.

Instead of incinerating wood wastes by direct, open-air burning, it has been proposed to incinerate wood wastes by "gasifying" them to produce a low BTU synthesis gas. Gasification, in theory, would produce little air pollution. Also, the production of usable synthesis gas in the gasification process would theoretically reduce the overall costs. However, the considerable operating problems inherent in building and operating a practical large scale device capable of such gasification have, until now, gone unresolved.

Batch-wise gasification operations have been found to be slow, inefficient and incapable of generating a constant flow of consistent quality synthesis gas.

Continuous gasification operations are generally more efficient and consistent, but they entail complex operating difficulties. Fluidized bed reactors, for example, have been tried, but have generally been found to be unsatisfactory. It is very difficult to monitor and maintain feed input within the narrow control ranges required for fluidized bed operation, and it is very difficult to rigorously separate the synthesis gas from the fluidized solid material.

Downwardly gravitating fixed bed reactors have also been tried. They have been found to be easier to operate than fluidized bed reactors, but unsolved operating difficulties remain. Most prominent of these operating difficulties is the necessity in fixed bed operations to somehow maintain continuous control of the gravitating solid bed of non-homogeneous wood waste particles in varying stages of combustion.

For example, non-homogeneous wood waste particles in a moving solid bed exhibit a tendency of the particles to interlace and bridge, thereby inhibiting downward flow. The breakup of such conglomerated material often requires considerable force. Due to the void area formed below such a bridge, the sudden break-up or collapse of the bridge often results in the rapid formation of uncontrolled channeling, fluidizing and "rat-holing" which result in unstable operation.

Bridging may occur on a small scale (a matter of inches) or on a large scale (traversing the entire bed).

A secondary and compounding effect of bridging is the resultant localized increased exposure of carbonaceous tar to localized high temperatures which can result in the rapid fusing of the particles to form large balls of slag ("clinkers"). Such slag promotes additional bridging.

Some localized bridging is unavoidable. The problems of operating a continuous gasification operation reduces to formulating a system which can successfully maintain solid bed reaction control despite such bridging.

No known prior art device has been able to satisfactorily deal with the problem of bridging and "clinkers" in a fixed bed continuous wood gasification operation. Continuous mixing or agitation of the bed has been recommended. However, it has been found that continuous mixing or agitation often promotes packing below the point of agitation due to the downward forces which increase vessel differential pressures (similar to the way that differential pressures develop across a clogged filter). The resulting high pressure continues to increase until a localized "blowout" occurs, whereupon temporary fluidizing and loss of particle bed control result.

Another problem inherent in the use of continuous gasification operations is the handling and disposal of tars and other high molecular weight materials which form in the hot, reducing atmosphere within the gasification reactor. Tar and other high molecular weight materials tend to condense downstream of the gasification reactor and plug up downstream equipment and piping. This is especially true in updraft (counter-current) continuous gasification devices.

There is therefore a need for a large scale continuous wood particle gasification system which can be continuously controlled to efficiently reduce non-homogenous particles of wood waste to a relatively tar-free fuel gas (without resulting in the release of large quantities of air pollutants).

SUMMARY OF THE INVENTION

The invention satisfies this need. The invention is a reactor and a method for producing synthesis gas by the partial oxidation of a solid fuel, especially a wood particle fuel.

The reactor has vertical side walls, a top head and a bottom head which cooperate together to form a reactor enclosure having a vertical longitudinal axis. A heating zone is defined within the reactor enclosure. The heating zone has substantially vertical side walls which terminate along a lower-most edge to form a heating zone discharge opening transverse to the longitudinal axis of the reactor. Preferably the heating zone is lined with refractory and slopes inwardly proximate to the heating zone discharge opening.

A closure grate is disposed within the reactor enclosure transverse to the longitudinal axis and immediately below the heating zone discharge opening. As so disposed, the closure grate forms a partial closure for the heating zone discharge opening and cooperates with the heating zone discharge opening to form an annular slit opening between the lower-most edge of the heating zone vertical walls and the periphery of the closure grate. The grate is capable of being reciprocated vertically between an upper-most closure grate position and a lower-most closure grate position. When the grate is vertically reciprocated, the annular slit opening is increased and then decreased.

Preferably, the closure grate reciprocating means comprises a rotatable horizontal drive shaft disposed below the closure grate and has rollers rotatably attached to the drive shaft by roller arms in such a way that when the drive shaft is rotated about its longitudinal axis, the rollers are rotated in a line perpendicular to the drive shaft. The drive shaft is disposed immediately below the closure grate so that the closure grate is supposed upon the rollers. When the drive shaft is rotated, the rollers rotate downwardly allowing the grate to travel downwardly an equivalent distance. As the rollers rotate back up again, they push the closure grate back to its original position. In this way, the annular slit opening is periodically expanded from an initial height of between about ½ inch and about 3 inches (most preferably between about 1 ¼ inches and about 1 ¾ inches) to a maximum height of between about 5 inches and about 12 inches (most preferably between about 6 inches and about 7 inches).

Preferably, a diffuser cone is disposed on the upper surface of the closure grate. The diffuser cone and the closure grate have openings which allow for the removal of gases from the heating zone to a location within the reactor enclosure below the closure grate. Preferably the openings in the diffuser cone are vertical slits having a width between about ⅜ inches and about ¾ inches, most preferably between about ⅜ inches and about ⅝ inches.

The reactor also preferably comprises a stirrer having a base element which is rotatably disposed on a stirrer drive shaft in such a way that the base element can be rotated within the reactor in a horizontal plane. Attached to the base element are a plurality of spaced-apart, downwardly directed finger elements which, when rotated with the base element, "rake" the top of a solids bed gravitating downwardly within the reactor enclosure. Most preferably, the stirrer drive shaft comprises two universal joints to allow the stirrer drive motor to be offset from the center of the reactor top head. This allows for the stirrer to be rotated directly below the solid fuel inlet opening.

Preferably, the partial oxidation reaction is fueled by air or some other source of molecular oxygen which is directed into the oxidation zone by a plurality of tuyeres disposed in a horizontal plane within the oxidation zone. Molecular oxygen from an external source is injected into each of the tuyeres via a suitable piping configuration.

The invention is ideally suited for solid fuels comprising essentially wood particles. A wide variety of wood wastes having a wide variety of particle sizes, moisture content, leaf contact etc. have been found to be processable in the invention. Also, spent telephone pole particles and other questionably toxic materials have been found to be processable within the reaction without yielding air pollution or toxic solid residues.

The reactor and method of the invention have been found to be much more efficient and controllable than prior art devices and methods, especially where the solid fuel is wood. The system shows remarkable flexibility, having a wide turn-down ratio and being relatively insensitive to operating upsets and minor mechanical breakdowns.

BRIEF DESCRIPTION OF THE DRAWINGS

These and other features, aspects and advantages of the present invention will become understood with reference to the following description, appended claims and accompanying drawings wherein:

DESCRIPTION OF THE INVENTION

Figure 1:
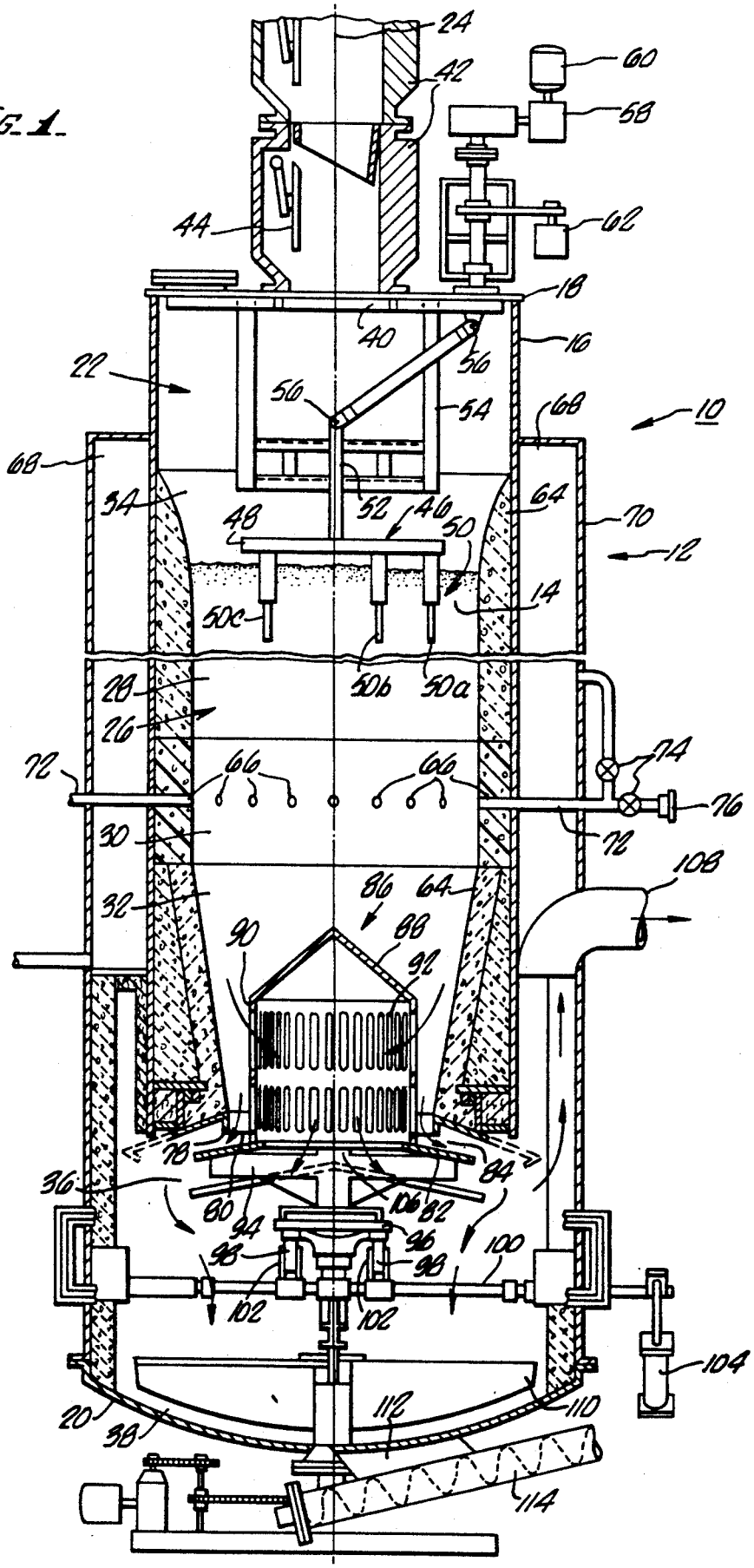
FIG. 1 is a cross-sectional view of a wood gasifier having features of the invention.

The wood gasifier of the invention 10 comprises a generally vertical reactor 12 adapted to process a gravitating solids bed 14 of particulate organic materials. The invention is ideally suited for processing non-homogeneous particles of wood, and the following description will discuss invention embodiments for gasifying wood wastes. The invention is not limited to wood wastes, however. Other solid organic materials can also be processed in the invention.

The reactor 12 comprises generally vertical side walls 16, a top head 18 and a bottom head 20 which cooperate to form an enclosure 22 having a vertical longitudinal axis 24. A refractory-lined heating zone 26 is defined within the reactor enclosure 20. The heating zone 26, in turn, defines a pyrolysis zone 28 int he upper-most portion of the heating zone 26, an oxidation zone 30 int eh middle portion of the heating zone 26, and a reduction zone 32 int he lower-most portion of the heating zone 26. Also defined within the reactor enclosure 22 is a feed inlet zone 34 (disposed above the heating zone 26), and syngas disengagement and char removal zones 36 and 38, respectively (disposed below the heating zone).

The reactor 12 further comprises an inlet opening 40 in the center of the top head 18 which is adapted to allow the influx of wood particle feed into the reactor 12. To minimize the backflow of gaseous materials and dust out of the reactor 12 during feed loading operations, a lock hooper 42 or series of lock hoopers 42 can be affixed across the inlet opening 40 in fluid communication with the reactor enclosure 22. As shown in FIG. 1, each such lock hopper 42 comprises a flapper valve 44 or similar mechanism adapted to allow the downward flow of wood particle feed through the lock hopper 42 in the direction of the reactor 12 while preventing the upward flow of gases and dust out of the reactor 12.

A source of sealing air (not shown) can be attached in fluid communication to one of the lock hoppers 42 to provide a small, constant influx of air into the reactor enclosure 22, and thereby inhibit the reverse flow of reactor gases and dust through the lock hoppers 42.

Within the reactor enclosure feed inlet zone 34 is disposed a means for evenly distributing the incoming wood feed particles across the full internal diameter of the reactor 12 and means for sensing the height of the wood particle bed 14 within the reactor enclosure 22. In the embodiment illustrated in FIG. 1, both such means are provided by a centrally disposed stirrer 46. The stirrer 46 comprises a horizontal base element 48 to which is attached a plurality of downwardly directed vertical stirrer blades 50. The base element 48 is adapted to rotate in a horizontal plane so as to cause the stirrer blades 50 to rake the upper-most portion of the solids bed 14. The base element 48 is rotated by a stirrer drive shaft 52 which is journalled within a stirrer support frame 54. The stirrer support frame 54, in turn, is rigidly affixed to the reactor 12. The stirrer drive shaft 52 is preferably connected via two universal joints 56 and a gear box 58 to a stirrer drive motor 60 disposed external of the reactor 12. The use of the two universal joints 56 in the stirrer drive shaft 52 allows the stirrer base element 48 to be centrally located within the reactor 12 directly below the reactor inlet opening 40.

In one preferred embodiment the stirrer 46 comprises three stirrer blades 50. The stirrer blades 50 are attached to the base element 48 so that (i) an outermost blade 50*a* is disposed between about 8 inches and about 12 inches from the inside surface of refractory 64, (2) an innermost blade 50*b* is disposed between about 8 inches and about 12 inches from the longitudinal axis of the reactor 24, and (3) an intermediate blade 50*c* is disposed to rotate about the longitudinal axis 24 in a circular path which is midway ±10% between the circular paths defined by the rotation about the longitudinal axis 24 of the outermost blade 50*a* and the innermost blade 50*b*.

Also, it is preferable that the stirrer drive shaft 52 be adapted with an adjustable torque-limiting mechanism and speed sensing mechanism (shown on the drawings collectively as element 62). When so equipped, the stirrer 46 also provides the means for sensing the level of particles within the reactor 12. When the rotating stirrer blades 50 are only partially submerged into the particle bed 14, the torque required for the rotation of the stirrer drive shaft 52 is relatively small. As the stirrer blades 50 become wholly submerged within the particle bed 14, the stirrer drive shaft torque noticeably increases. If the stirrer base element 48 becomes submerged in the particle bed 14, the stirrer drive shaft torque greatly increases, the stirrer drive shaft speed decreases and the fact of this decrease is sensed and relayed to appropriate control equipment by the speed sensing mechanism.

As mentioned above, the internal walls of the heating zone 26 are lined with refractory 64 to protect the reactor walls 16 from the high temperatures generated during operation. As shown in FIG. 1, it is generally preferable to inwardly taper the refractory 64 within the reduction zone 32 to funnel the solids material to the annular slit opening (described below) at the base of the heating zone 26. However, there may be cases where non-tapered refractory 64 or outwardly tapered refractory 64 are preferable (to increase the area available for removal of synthesis gas at the base of the heating zone 26).

A plurality of evenly-spaced tuyeres 66 are disposed radially around the reactor 12 within the oxidation zone 30. The tuyeres 66 are small cylindrical tunnels disposed horizontally through the refractory 64. Preferably, the tuyeres 66 are lined with a heat-resistant metal such as type 316 stainless steel. Each such liner is sealed within the refractory 64 to prevent hot reaction gases from penetrating to the reactor side wall 16. The liners are disposed flush with the internal vertical surface of the refractory 64 to prevent their reactive deterioration and to prevent their interfering with the downward gravitation of the particle bed 14.

An air plenum 68, formed by an air plenum wall 70, is disposed around the vertical side walls 16 of the reactor 12 to provide a reservoir for the distribution of combustion air to the tuyeres 66. A combustion air inlet conduit 72 is attached in fluid communication between the air plenum 68 and each tuyere. Preferably, each combustion air inlet conduit 72 includes valves 74 or other means for controlling the flow rate of combustion air therethrough and/or for allowing the injection of steam into the reactor 12. Also, it is preferable that one or more of the combustion air inlet conduits 72 be provided with a view port 76 as shown in FIG. 1 to allow operations personnel to visually monitor the particle bed 14 in the oxidation zone 30. More preferably, all of the combustion air inlet conduits 72 are provided with a view port 76.

The heating zone terminates at a lower-most edge 78 to form a heating zone discharge opening 80 which is generally transverse to the longitudinal axis 24 of the reactor 12. A closure grate 82 is disposed immediately below the heating zone discharge opening 80 in such a way that the closure grate 82 forms a partial closure for the heating zone discharge opening 80 and cooperates with the lower-most edge of the heating zone 78 to form an annular slit opening 84 between the lower-most edge 78 of the heating zone 26 and the grate 82. The grate 82 can be made of a thick mild steel, stainless steel or other suitable heat-resistant material. The grate 82 is preferably downwardly slanted in the outward direction to facilitate the gravitational flow of solid material off of the grate 82 and into the syngas disengagement and char removal zones 36 and 38.

A diffuser cone 86 is centrally disposed on top of the closure grate 82 so that the diffuser cone 86 protrudes upwardly into the reduction zone 32. The diffuser cone 86 has a conical upper portion 88 ("hat"). The diffuser cone 86 is comprised of type 304 or 316 stainless steel or other heat-resistant material. Preferably, the apex angle of the conical upper section 88 is less than about 50°. Greater angles tend to inhibit the downward gravitation of the solid bed. It is important, however, that the apex angle not be so narrow that the upper conical section 88 of the diffuser cone 86 extend too close to the oxidation zone 30 (where it will be exposed to excessive temperatures). Where the upper conical section 88 is constructed of type 304 or 316 stainless steel, it has been found to be preferable to maintain the apex of the diffuser cone 86 at least about 18 inches below the tuyere 66 inlets.

The vertical sides of the diffuser cone 90 define a plurality of vertical diffuser cone slits 92 which are adapted to allow the flow of syngas out of the reduction zone 32 and into the interior defined by the diffuser cone 86, without allowing the solid material to leak out of the bed 14. The diffuser cone slits 92 are between about ⅜ inch and about ¾ inch in width. Narrower slits 92 inhibit the flow of syngas while wider slits 92 allow the passage of excessive amounts of solids material. Slits 92 between about ½ inch and about ⅝ inch are most preferable. Slits 92 of this width tend to optimize the separation of syngas and solid materials and minimize the tendency of the solids materials to clog the slits 92.

The diffuser cone 86 is provided with the maximum number of slits 92 within strength limitations. To provide for adequate strength, the diffuser cone 86 is supported internally by a plurality of cross braces (not shown) disposed between opposite walls 90 on the interior of the diffuser cone 86.

The diffuser cone 86 is generally constructed with the maximum diameter which will still allow sufficient flow of solids material to the heating zone discharge opening 80 and which will not contact the inner refractory 64 during vertical reciprocation. By maximizing the diameter of the diffuser cone 86, a maximum of synthesis gas can be removed from the solids bed 14 above the closure grate 82.

The closure grate 82 is disposed upon a grate support frame 94 which is affixed to a grate carriage 96. The grate carriage 96 is supported on a pair of rollers 98 which are each rotatably attached to a grate reciprocation drive shaft 100 by a pair of roller arms 102. The grate reciprocation drive shaft 100 is rotatable by a pneumatic actuator 104 or similar choice disposed outside of the reactor 12. Preferably the drive shaft 100 is adapted with water cooling or other means to maintain the drive shaft 100 at a reduced temperature.

The grate carriage 96 is disposed supported upon the pair of rollers 98 in such a way that, when the grate reciprocation drive shaft 100 rotates, the rollers 98 initially rotate downwardly (like cams on a cam shaft) allowing the grate carriage 96 to gravitate downwardly. As the gate reciprocation drive shaft 100 continues to rotate, the rollers 98 rotate back upwardly. This action pushes the grate carriage 96 upwardly to its original position. Such downward and then upward reciprocation of the grate carriage 96 necessarily causes an equivalent downward and then upward reciprocation of the grate 82. Such reciprocation of the grate 82, in turn, causes the vertical height of the annular slit opening 84 to periodically widen and then narrow. This periodic widening and then narrowing of the annular slit opening 82 facilitates the controlled gravitation of the solid residue material out of the heating zone 26 and into the disengagement zone 36. It also gently mixes the solids bed within the heating zone 26 to minimize bridging and reduce channeling and localized hot spots.

The grate 82 is normally operated in the upper-most position wherein the annular slit opening 84 is in a closed-most position and is between about ½ inch and about 3 inches high, preferably between about 1 ¼ inches and about 1 ¾inches high. When the grate 82 is periodically reciprocated, the slit opening 84 expands to an open-most position, wherein it is between about 5 inches and about 12 inches high (preferably between about 6 and about 7 inches high), and then contracts to the closed-most position. In a typical embodiment, the grate 82 and associated hardware is adapted to complete a reciprocation cycle in 2–6 seconds and to initiate a reciprocation cycle every 6–60 seconds.

When the grate 82 is periodically reciprocated, char is drawn downwardly from the bottom of the solids bed 14 and allowed to rapidly pass through the expanded annular slit opening 84 to the char removal zone 38. It has also been discovered that, when the grate 82 is periodically reciprocated, fines and char lodged on the cone slits 92 are scrubbed free. The reciprocation of the grate 82, therefore, cleans the diffuser cone 86 and keeps it from becoming plugged.

It has been found that this reciprocating action of the closure grate 82 greatly facilitates the operation of the reactor 12 by gently agitating the solids bed 14 in the critical operational zone near the base of the bed 14. The periodic reciprocation of the closure grate 82 and the diffuser cone 86 facilitates the maintenance of a constant differential pressure between the upper portions of the solids bed 14 and the base of the solids bed 14 and a constant differential pressure between the base of the solids bed 14 and the syngas disengagement zone 36. Operation problems due to localized bridging is minimized without inducing destabilizing channelling and "rat-holing".

Most of the synthesis gas is removed from the solids bed 14 via the diffuser cone 86, and passed through a central opening 106 in the closure grate into the syngas disengagement zone 36 (located immediately below the closure grate 82). A small portion of the synthesis gas also exits the heating zone 26 through the annular slit opening 80.

In the syngas disengagement zone 36, the solid char particles fall out of the synthesis gas to the bottom of the reactor enclosure 22. The relatively large volume of the chamber 36 causes the velocity of the gas to markedly decrease which results in the de-entrainment of the char particles. The largely char-free synthesis gas passes upwardly out of the syngas disengagement zone 36 via a synthesis gas discharge annulus 108 and out of the reactor 12 to downstream synthesis gas clarification and handling equipment. The relatively large volume and the vertical orientation of the gas discharge annulus 108, contribute further to the de-entrainment of the char material.

The char gravitates to the char removal zone 38 in the bottom of the reactor enclosure 22 and is swept by rotating char scraper blades 110 to a char removal opening 112 defined in the bottom head 20 of the reactor 12. The char gravitates out of the reactor 12 via the char removal opening 112 which is in fluid communication with a sealed exhaust augur 114. The auger 114 transports the char to a char repository (not shown).

In operation, wood particle feed stock is first prepared by reducing a source of waste wood material to pieces or particles generally ranging between about ¼ inch and about 8 inches. A hammer mill or other suitable equipment can be used to accomplish this task. The waste wood material can be any of a wide variety of materials. Commercial wood particle feed stock can be processed in the invention as can tree trimmings and spent telephone poles. The mean particle size is not critical. It is preferable, however, that the particles be as relatively free of fines and be as uniform in size as possible to minimize packing and bridging and to maximize ease of control. Continuous operation can be maintained with about 5–10 weight percent fines and pieces up to about 1"×2"×10". The optimum particles (from an ease of operations standpoint) are cubical briquettes having an edge length between about one inch and about 2 inches.

If the wood waste is moist, it is preferable to dry it as much as possible before processing it. Although continuous operation is possible with woods having a moisture content of 30–35% by weight, it is preferable that the moisture content of the wood be less than about 20% by weight. Woods with high moisture content, high fines content, leaves or other processing impediments can best be processed by blending them with higher quality feed stocks, such as dry uniform industrial carpentry wastes.

The wood feed stock is transported to the top of the reactor 12 by conveyor belt or other suitable transport means. The feed stock is introduced into the reactor 12 via the lock hoppers 42 to minimize the escape of gaseous reaction products and dust from the reactor 12. Sealing air can be introduced into the lock hoppers 42 at a pressure higher than the reactor pressure to further minimize the reverse flow of gaseous products and dust. The flow of sealing air should be controlled, however, to minimize undue pressure buildup in the reactor feed inlet zone 34.

The wood particle feed stock can be automatically introduced into the reactor 12 periodically at timed intervals or in response to a low level of feed stock in the reactor feed inlet zone 34 as sensed by the reactor stirrer 46. Feed is introduced into the reactor 12 until the feed inlet zone 34 is full (as also sensed by the reactor stirrer 46).

It is preferable to design and operate the reactor 12 so that a volume of non-combusted wood is always maintained near the top of the reactor 12. This keeps the top of the reactor 12 and the stirrer 46 from overheating.

The reactor 12 should also be designed and operated to achieve an optimum feed input cycle. Relatively frequent feed input cycles result in relatively smooth operation and consistent quality of synthesis gas output but may result in relatively high leakage of gaseous materials and dust to the atmosphere during feeding operations. Relatively infrequent feed input cycles, on the other hand, minimize leakage but result in increased variation in synthesis gas product. Fill cycles of one-third to two-thirds of an hour have been found to be satisfactory.

During operation, the wood feed particles gravitate downwardly from the feed inlet zone 34 into the pyrolysis zone 28 where heat rising from the oxidation zone 30 raises the temperature of the wood particles in the pyrolysis zone 28 to between about 400 and about 900° F. This heating preheats and drives off much of the volatile content of the feed stock.

From the pyrolysis zone 28, the feed stock gravitates into the oxidation zone 30. There, air entering the oxidation zone 30 via the tuyeres 66 oxidatively reacts with the wood material. The oxygen introduced into the oxidation zone 30 provides between about 20% and about 30% of the stoichiometric combustion requirement for the wood material. The resulting partial oxidation of the wood material raises the temperature within the oxidation zone 30 to between about 2000° and about 2700° F.

From the oxidation zone 30, the solid particles gravitate into the reduction zone 32 where the temperature falls to between about 1200° and about 1500° F. At these temperatures and in the absence of molecular oxygen, the following endothermic reactions take place:

$$C+CO_2 \longleftrightarrow 2CO$$

$$CO+H_2O \longleftrightarrow CO_2+H_2$$

$$C+H_2O \longleftrightarrow CO+H_2$$

$$C+2H_2 \longleftrightarrow CH_4$$

The resulting reaction products form a synthesis gas comprising the combustibles methane, carbon monoxide and molecular hydrogen. This synthesis gas is a clean burning, low BTU fuel gas.

Also in the reduction zone 32, substantially all of the high molecular weight tar materials (which tend to be formed in the pyrolysis zone) are "cracked" to simple hydrocarbon compounds.

The gravitating particle bed 14 is gently agitated by periodically reciprocating the closure grate 82 in the vertical direction. Grate reciprocation cycle frequencies between about 2 ½ minutes and about 10 minutes can be used in the method of the invention. If the differential pressure across the particle bed 14 increases above a pre-determined control figure, the frequency of the closure grate vertical reciprocation can be increased.

The synthesis gas is removed from the reactor 12 via the synthesis gas discharge annulus 108. The gas is taken downstream of the reactor 12 where entrained particulate material is removed in a cyclone or other gas-solids disengagement device. Thereafter, the synthesis gas can be used as a fuel gas to provide valuable heat. To minimize the buildup of trace quantities of tar in the synthesis gas equipment downstream of the reactor, it is preferred that such downstream equipment be preheated above about 400°-500° F. during operation.

The char particle solid residue is removed from the reactor 12 via the char removal opening 112 and is transported to a char repository by the sealed auger 114. The process is flexible enough that if the sealed auger 114 or char repository breaks down or is taken out of service, the reactor 12 can continue to operate for several hours. (Char will build up within the char removal zone 38 and ultimately may be carried out of the reactor 12 with the synthesis gas. Any such char in the synthesis gas, however, will be mostly removed in the cyclone or other gas-solids disengagement device.)

The char removed from the reactor 12 has about 7% of the weight of the initial feed stock. It is about 78% by weight carbon, 21% by weight ash and has a heating value of about 12,800 BTU per pound. The char can generally be disposed in a non-toxic landfill or it can be blended into a suitable fuel gas system where it is totally gasified while providing additional quantities of valuable heat.

EXAMPLE

Using the method and apparatus having features of the invention, about 1,225 pounds per hour of waste wood feed stock were gasified to yield about 2,840 pounds per hour of synthesis gas having a heating value of about $7.4\times10^6$ BTU.

The reactor used in the gasification was cylindrical and had a height of about 35 feet and an outside diameter of about 94 inches. The reactor was generally constructed of ¼ inch thick carbon steel but had a top head constructed of ¾ inch thick carbon steel.

The wood particle feed stock was a commercial wood mixture comprised of diverse sizes of pins and blocks which had been produced with a commercial hammermill from clean manufacturing and construction scrap. The wood particle feed comprised about 5 to 8 weight percent fines and pieces as large as 14 inches in length. The wood particle feed stock comprised about 14.2 weight percent water. On a dry basis, the wood particle feed stock contained about 50 weight percent carbon, 6 weight percent hydrogen, 42 weight percent oxygen, 0.1 weight percent nitrogen and 1.9 weight percent ash.

Incoming wood feed was transported to the lock hoppers by a cleat type conveyor belt. The feedstock was passed through a series of three lock hoppers installed on the top of the reactor in fluid communication with the reactor inlet opening. Forty-five pounds per hour of sealing air was injected into the lock hoppers to minimize reverse flow through the lock hoppers.

The reactor was filled with waste wood particle feed at intervals between about 20 and about 30 minutes. Wood particle feed was allowed to fill the reactor to about 60 inches above the tuyere level. It was found that longer fill intervals (60 minutes or more) tended to cause the temperature of the uninsulated reactor top head to rise above 700° F.

The reactor was fitted with a stirrer driven by an external motor via a gear box and two internal universal joints. The horizontal base element of the stirrer was about 38 inches long. Attached to the horizontal base element were three downwardly directed stirrer blades, disposed in parallel. Each of the blades was constructed of ¼ inch steel flat stock and each was 6 inches long and 1 inch wide. Each of the blades was disposed with the ¼ inch edge facing the direction of travel. The stirrer system also included a mechanism for sensing the torque applied to the stirrer drive shaft by the wood, and the stirrer was used as an automatic level sensing and feed cycle controlling device.

The heating zone of the reactor was approximately 100 inches in height and the central zone was internally lined with high alumina plastic refractory. The internal diameter of the heating zone above the reduction zone was 55 inches. In the reduction zone, the refractory was tapered inwardly (from top to bottom) to a minimum diameter of about 40 inches.

An air plenum was provided around the outside of the reactor. From the air plenum, 16 combustion air inlet conduits were disposed in fluid communication with 16 equally spaced tuyeres defined within a horizontal plane in the refractory in reactor oxidation zone. Each of the tuyeres had a nominal diameter of about one inch and was lined with a sleeve constructed of ¾ inch type 316 stainless steel tubing. Each of the sleeves was made flush to the internal surface of the refractory.

The 1,225 pounds per hour of wood particle feed stock were reacted with 1,610 pounds per hour of combustion air which was injected into the air plenum at about 120° F. and 3–5 psig. The internal pressure within the reactor ranged between about 3 and about 5 psig.

The oxidation zone was usually inspected once per hour through view ports built into all of the combustion air inlet conduits. All tuyeres were mechanically rodded once every eight hours to loosen any agglomerations which may have formed in the immediate vicinity of the tuyere.

A grate which was constructed of one-inch thick mild steel was disposed on a steel carriage immediately below the lower-most edge of the heating zone sidewalls, so as to define an annular slit opening having a minimum height of about 1 and ¼ inches. The grate was radially inclined toward the center of the grate to facilitate the outward gravitation of solid particles passing through the annular slit opening.

Attached to the upper surface of the grate and disposed upwardly into the heating zone was a diffuser cone constructed of a 30-inch section of 30-inch nominal diameter, type 304 stainless steel pipe with a conical "hat" sealed to the upper edges of the pipe section. The conical hat was also constructed of type 304 stainless steel. The apex of the diffuser cone was made to be less than about 18 inches below the tuyere openings.

Two rows of diffuser opening slits were made in the sides of the pipe section, an upper row and a lower row. Each of the slits was ½ inch wide and 12 inches long. The slits were disposed vertically and in parallel. The slits in each row were separated from each other by 1 inch of metal.

During operation, the grate was normally held in its upper-most position. Periodically the grate was reciprocated down to its lower-most position and then back up to its upper-most position in a continuous step. The vertical reciprocation of the grate increased and then decreased the annular slit opening between a height of about 1 ¼ inch and a height of about 6 inches. The grate was reciprocated about every five minutes, unless the differential pressure across the solids bed increased above 2 psi, when the reciprocating frequency was increased to a stroke every two and one-half minutes. It was found that if the grate reciprocating frequency was too large (e.g., one stroke every 10–15 minutes), the differential pressure across the solids bed increased above 2.5 psi. It was also found that if the grate reciprocating frequency was continuously too short (e.g., 2–3 minutes), the process produced more char and vaporized tar.

The synthesis gas was removed from the reactor at about 1000° F. The synthesis gas taken from the reactor was passed through a stainless steel-lined cyclone where most of the entrained particulate matter was removed.

The 2,840 pounds per hour of synthesis gas removed in the process contained about 18 weight percent $H_2O$. On a dry basis the remainder of the gas contained about 25 weight percent CO, 10 weight percent $CO_2$, 13.6 weight percent $H_2$, 3.6 weight percent $CH_4$, 0.7 weight percent $C_2H_4$, 0.3 weight percent $C_3H_8$ and 47 weight percent $N_2$. Entrained with the raw synthesis gas was about 2.5 pounds per hour of particulate matter and about 6.3 pounds per hour of oil and tar vapor. The synthesis gas had a heating value of about 170 BTU per standard cubic foot (dry basis). The total heat output from the synthesis gas (including sensible and latent heats and the heating value of the particulates, oil and tar) was about $7.4\times10^6$ BTU per hour.

The bulk of the char material produced in the reaction was removed from the bottom of the reactor using a char blade to sweep the char material through the reactor outlet opening and into a sealed exhaust auger. The auger then transported the char to a char repository from where it was periodically removed to a non-toxic landfill.

The char produced in the gasification operation was about 91 pounds per hour and consisted of 78 weight percent carbon, 1 weight percent hydrogen, 0.3 weight percent nitrogen and 20.7 weight percent ash. The char had a heating value of about 12,800 BTU per pound.

It was calculated that about $0.3\times10^6$ BTU per hour of heat was lost during the gasification process to the atmosphere and to cooling water used to cool the grate reciprocating mechanism and choke support.

Although the present invention has been described in considerable detail with reference to certain preferred versions, other versions are possible. Therefore, the spirit and scope of the appended claims should not necessarily be limited to the description of the preferred versions contained herein.

What is claimed is:

1. A reactor for producing synthesis gas by the partial oxidation of a solid fuel, the reactor comprising:

(a) vertical external sidewalls, a top head, and a bottom head which cooperate together to form an enclosure having a vertical longitudinal axis;

(b) a heating zone defined within the enclosure, the heating zone having substantially vertical heating zone sidewalls disposed within the sidewalls of the reactor, the heating zone walls terminating along a lower-most edge which edge is disposed in a horizontal plane;

(c) a plurality of tuyeres disposed in a horizontal plane within the heating zone, each tuyere being in fluid communication with an external source of molecular oxygen, so that molecular oxygen can be transferred form the source of molecular oxygen to the heating zone;

(d) a closure grate having a perimeter and a center and disposed transverse to the longitudinal axis of the heating zone below the heating zone in such a way that the grate cooperates with the lower-most edge of the heating zone vertical walls to form an annular slit opening between the lower-most edge and the grate; and (e) reciprocating means for vertically displacing the closure grate between an upper-most closure grate position and a lower-most closure grate position so as to periodically increase and decrease the size of the annular slit opening.

2. The reactor of claim 1 wherein the vertical side walls of the heating zone taper inwardly proximate to the slit opening.

3. The reactor of claim 2 wherein a portion of the vertical side walls of the heating zone tapers inwardly so that the diameter of the heating zone reduces down from a first diameter to a second diameter.

4. The reactor of claim 1 further comprising a gas diffuser cone disposed atop the closure grate, the diffuser cone having openings which allow the removal of gases form the heating zone.

5. The reactor of claim 1 wherein the openings in the diffuser cones are vertical slits having a width between about $\frac{3}{8}$ inches and about $\frac{3}{4}$ inches.

6. The reactor of claim 5 wherein the openings in the diffuser cones are vertical slits having a width between about $\frac{3}{8}$ inches and about $\frac{5}{8}$ inches.

7. The reactor of claim 5 wherein the diffuser cone comprises a conical top member.

8. The reactor of claim 5 wherein the vertical height of the diffuser cone is less than about 18 inches below the horizontal plane wherein is disposed the plurality of tuyeres.

9. The reactor of claim 1 wherein the reciprocating means comprises a rotatable horizontal drive shaft disposed below the closure grate, rollers rotatably attached to the shaft by roller arms such that when the drive shaft is rotated about its longitudinal axis, the rollers are rotated in a plane perpendicular to the drive shaft; the rollers being disposed below the closure grate so that when the drive shaft is rotated, the rollers contact the closure grate and move the closure grate form the lower-most closure grate position to the upper-most closure grate position.

10. The reactor of claim 1 wherein the reciprocating means changes the size of the annular slit opening by between about 3 inches and about 12 inches.

11. The reactor of claim 1 wherein the annular slit opening has a height when the grate is in the upper-most grate position between about $\frac{1}{2}$ inch and about 3 inches and has a height when the grate is in the lower-most grate position of between about 5 inches and about 12 inches.

12. The reactor of claim 1 further comprising a stirrer, stirrer having a base element which is rotatably disposed on a stirrer drive shaft in such a way that the base element can be rotated within the reactor in a horizontal plane, and also having a plurality of downwardly directed, spaced-apart finger elements attached to the base element.

13. The reactor of claim 12 wherein the stirrer drive shaft comprises two universal joints.

14. The reactor of claim 12 wherein the stirrer comprises three finger elements, a first finger element disposed between about 8 and about 12 inches from the vertical walls of the heating one, a second finger disposed between about 8 and about 12 inches from the longitudinal axis of the reactor and a third finger disposed to rotate about the longitudinal axis of the reactor in a circular path which is in between the circular paths defined by the rotation about the longitudinal axis of the reactor by the first and second finger elements.

15. The reactor of claim 1 wherein the vertical heating zone walls are lined with refractory and wherein the tuyeres are disposed flush with the refractory.

16. The reactor of claim 1 wherein the center of the closure grate is disposed at a higher elevation than the perimeter of the closure grate.

* * * * *